US012359520B1

(12) United States Patent
Al-Shaikh

(10) Patent No.: US 12,359,520 B1
(45) Date of Patent: Jul. 15, 2025

(54) ACTIVE GRASPING WIRELINE FISHING TOOL

(71) Applicant: SAUDI ARABIAN OIL COMPANY, Dhahran (SA)

(72) Inventor: Abdulkareem Abdullah Al-Shaikh, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/776,345

(22) Filed: Jul. 18, 2024

(51) Int. Cl.
*E21B 31/12* (2006.01)

(52) U.S. Cl.
CPC ..... *E21B 31/125* (2013.01)

(58) Field of Classification Search
CPC ..... E21B 31/125
See application file for complete search history.

(56) References Cited

U.S. PATENT DOCUMENTS 720,078 A * 2/1903 Smith ..... E21B 31/18 294/86.28
1,498,251 A * 6/1924 Trailor ..... E21B 31/125 294/115
1,527,130 A * 2/1925 Griffith ..... E21B 31/20 294/86.27
2,886,369 A * 5/1959 Decuir ..... E21B 31/125 294/86.12
4,225,173 A * 9/1980 Martinez ..... E21B 31/12 294/61
4,453,756 A * 6/1984 Haag ..... E21B 31/18 294/86.27
11,952,852 B1 * 4/2024 Al-Mousa ..... E21B 31/125
2016/0010416 A1 * 1/2016 Armstrong ..... E21B 31/18 166/99
2017/0114604 A1 * 4/2017 Kartha ..... E21B 31/18
2023/0243225 A1 * 8/2023 Abel ..... E21B 31/125 294/86.1
2024/0368955 A1 * 11/2024 Billingham ..... E21B 31/125

OTHER PUBLICATIONS

Elmar Tools, Wireline & Flow Control Products; retrieved from https://www.nov.com/-/media/nov/files/products/caps/intervention-and-stimulation-equipment/slickline-tools-and-flow-control/elmar-wireline-tools-catalog.pdf.
Hunting, Gauge Cutters retreived from https://media.huntingplc.com/products-and-services/well-intervention-equipment/slickline-equipment/tubing-clearance-cleaning/hunting-gauge-cutter-datasheet.pdf.

* cited by examiner

*Primary Examiner* — Shane Bomar
(74) *Attorney, Agent, or Firm* — Vorys, Sater, Seymour and Pease LLP

(57) ABSTRACT

A wireline fishing tool is disclosed including a body, a side prong extending from a lateral side of the body, and a central prong extending from a center of the body. The central prong is movable relative to the body between an extended state and a retracted state. The central prong comprises a toothed shaft retractable with respect to the body to move the central prong from the extended state to the retracted state and a tooth movable relative to the toothed shaft between a stowed state in which the tooth is disposed within the toothed shaft and a deployed state in which the tooth extends from the toothed shaft. The tooth is movable from the stowed state toward the deployed state based on the central prong moving from the extended state to the retracted state.

15 Claims, 6 Drawing Sheets

ACTIVE GRASPING WIRELINE FISHING TOOL

FIELD OF THE DISCLOSURE

The present disclosure relates generally to wellbore fishing operations and, more particularly, to a wireline fishing tool for the retrieval of wireline and wireline tooling lost downhole.

BACKGROUND OF THE DISCLOSURE

Many oil and gas well construction services employ wireline to convey specialized wireline tooling within a wellbore for plugging, perforation, cleaning, and logging operations. However, during these wireline operations there is a risk of damage to the wireline or the wireline tooling, which can sometimes result in the wireline being cut or severed within the wellbore. When the wireline is severed, the tooling, and a section (length) of the wireline still attached to the tooling, may be dropped into the wellbore and left downhole. The tooling and attached lengths of loose wireline left within the wellbore are unavailable for use in subsequent operations, and in some cases can disrupt hydrocarbon extraction operations in the wellbore. In such cases, a fishing operation is performed to recover the wireline tooling and any corresponding equipment from the wellbore. There are various fishing tools known in the art, such as overshot tools, fishing magnets, and wire grabbers, which may be selected based on the type of equipment lost in the wellbore (i.e., "fish").

One challenge encountered during a fishing operation is that the selected wireline fishing tool may not be able to catch or grasp onto the lost wireline. This can occur due to a variety of factors, such as the wireline being in a difficult-to-reach area, the wireline being severely damaged, and/or the wireline not having a suitable catching point. In such instances, additional strategies may be employed to retrieve the wireline and the wireline tooling. For example, altering the fishing tool configurations or using additional, specialized technology may be attempted. These additional strategies may increase the downtime of the wellbore, lead to increased costs, and/or jeopardize the planned operations in the wellbore resulting in the wellbore needing to be abandoned or having a side-tracked wellbore drilled therefrom.

Accordingly, an improved wireline fishing tool is desirable to reduce non-productive time and the need to abandon the wellbore or drill a side-tracked wellbore therefrom.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a wireline fishing tool is disclosed including a body, at least one side prong extending from a lateral side of the body, and a central prong extending from a center of the body. The central prong is movable relative to the body between an extended state and a retracted state. The central prong includes a toothed shaft retractable with respect to the body to move the central prong from the extended state to the retracted state and a tooth movable relative to the toothed shaft between a stowed state in which the tooth is disposed within the toothed shaft and a deployed state in which the tooth extends from the toothed shaft. The tooth is movable from the stowed state toward the deployed state based on the central prong moving from the extended state to the retracted state.

According to an embodiment consistent with the present disclosure, a method is disclosed including conveying a wireline fishing tool downwardly through a wellbore, radially compressing a wireline into the wireline fishing tool by engaging the wireline with at least one side prong of the wireline fishing tool based on the wireline fishing tool being conveyed downwardly through the wellbore, driving a central prong of the wireline fishing tool from an extended state toward a retracted state, and pulling the compressed wireline upwardly with the central prong based on the central prong moving toward the retracted state.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
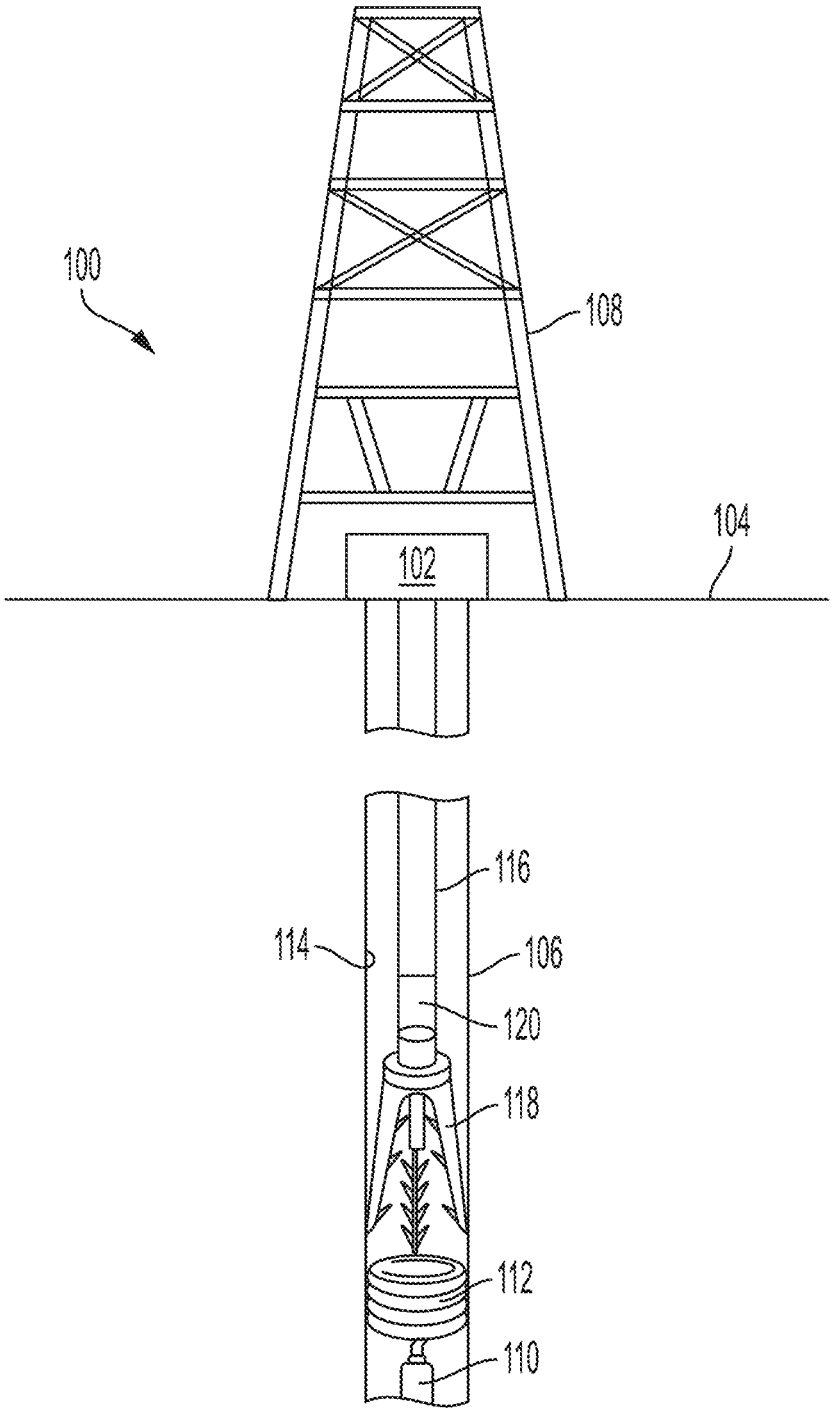
FIG. 1 is a schematic view of a well system including a wireline fishing tool with first, second side prongs and a third central prong, according to at least one aspect of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to wellbore fishing operations and, more particularly, to a wireline fishing tool for the retrieval of lost wireline and wireline tooling from downhole. The wireline fishing tool may include first, second, and third prongs operable to grasp a loose wireline in a wellbore. The third prong may include teeth that are selectively extendable under the influence of a spring or similar mechanism to positively grip the wireline. The wireline fishing tool described herein may reduce the chance of losing sheared wireline, increase the chances of successful wireline fishing operations, and reduce costs through a reduction in both tripping downhole and non-productive time.

FIG. 1 is a schematic view of a well system 100, according to at least one aspect of the present disclosure. As illustrated, the well system 100 (hereafter "the system 100") includes a wellhead 102 installed at a surface location 104, such as the Earth's surface, and a wellbore 106 that extends from the wellhead 102. The wellbore 106 may be cased, open hole, contain tubing, and/or may generally be characterized as a hole in the ground having a variety of shapes and/or geometries as are known to those of skill in the art. While the system 100 is depicted in FIG. 1 as a land-based system, the principles described herein are equally applicable to subsea operations that employ floating or sea-based platforms and rigs, without departing from the scope of the disclosure.

The system 100 may be configured to undertake a variety of downhole operations using a variety of downhole tools and systems. In at least one embodiment, the system 100 may be suitable for conducting downhole wireline operations. Accordingly, while not shown, the system 100 may include conventional surface equipment configured to facilitate downhole wireline operations used in conjunction with a derrick 108, or additional surface tooling not shown herein.

In the illustrated embodiment, a wireline tool 110 is shown dropped within the wellbore 106. The wireline tool 110 may have been previously conveyed into the wellbore 106 on a wireline 112, and at some point during the previous wireline operation, the wireline 112 was cut or otherwise severed. As a result, the wireline tool 110 is untethered to the surface location 104, and may thus be described as effectively "lost" within the wellbore 106. Moreover, the wireline 112 has fallen within the wellbore 106 under the force of gravity and may be loosely coiled atop the wireline tool 110 and against an interior surface 114 of the wellbore 106. At this point, a wellbore fishing operation may be employed to retrieve the wireline tool 110. The loose wireline 112, however, may provide an obstacle to accessing the wireline tool 110.

According to embodiments of the present disclosure, the system 100 may further include a wireline fishing tool 118 conveyable into the wellbore 106 and actuatable to grasp onto and retrieve the loose wireline 112, and the wireline tool coupled thereto, in a safe and efficient manner. Once secured to the loose wireline 112, the wireline fishing tool 118 may be retrieved to the surface 104, thereby simultaneously pulling the wireline 112 and (potentially) the interconnected wireline tool 110 to the surface 104.

In one or more embodiments, the wireline fishing tool 118 may be conveyed into the wellbore 106 on a conveyance 116. In some embodiments, the conveyance 116 may include coiled tubing or drill pipe, which may be configured to be rigid enough to transmit an axial load (e.g., a downhole load) to the fishing tool 118 from the surface location 104. The transmitted axial load may be imparted to (assumed by) the fishing tool 118 to axially compress or "compact" the loose wireline 112 coiled within the wellbore, while simultaneously gathering the loose wireline 112 into a more manageable state. In some other embodiments, for example, the conveyance 116 may comprise a relatively flexible member such as a wireline or slickline (not shown) without departing from the scope of the disclosure. In at least one embodiment, further tooling, such as logging or measurement instruments, may be included as part of a bottom-hole assembly (not shown) installed on the conveyance 116, without departing from the scope of this disclosure.

Figure 2:
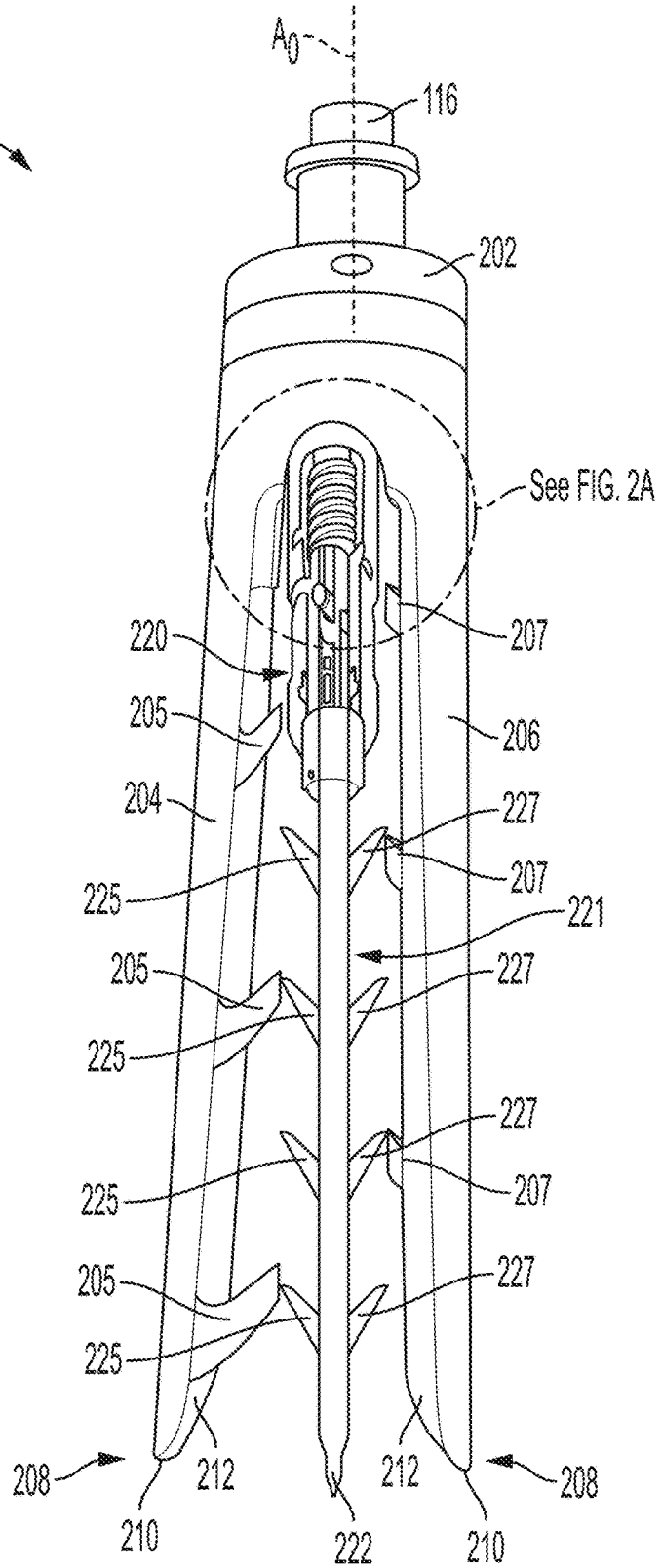
FIG. 2 is a detailed view of the wireline fishing tool of FIG. 1, according to at least one aspect of the present disclosure.

Referring now to FIG. 2, a detailed view of the wireline fishing tool 118 is provided, according to at least one aspect of the present disclosure. The wireline fishing tool 118 includes a body 202 coupled to a lower end of the conveyance 116 and defining a longitudinal axis $A_0$. The wireline fishing tool 118 also includes a first side prong 204 extending from an outer perimeter of the body 202 on a first lateral side thereof, and a second side prong 206 extending from the outer perimeter of the body 202 on a second lateral side thereof opposite of the first lateral side. In some embodiments, the first and second side prongs 204, 206 are generally rigid members constructed of a metallic material such steel. In other embodiments the side prongs 204, 206 may be constructed of other materials such as thermoplastics or ceramics. In one aspect, as shown in FIG. 2, the first side prong 202 and the second side prong 204 are radially offset by 180° on the outer perimeter of the body 202. In other aspects, the first side prong 202 and the second side prong 204 are radially offset by less than 180°, such as 45°, 90°, 135°, as examples. In other aspects, the wireline fishing tool 118 includes more than two side prongs extending from the outer perimeter of the body 202, such as three, four, or five side prongs, as examples. In some such aspects, the side prongs are equally, radially positioned about the perimeter of the body 202. In one such aspect, three side prongs extend from the body 202 and are radially offset by 120°. In another such aspect, four side prongs extend from the body 202 and are radially offset by 90°. Other aspects are envisioned where the side prongs are not equally, radially spaced about the perimeter of the body 202.

In one aspect, the body 202, the first side prong 204, and the second side prong 206 are constructed as an integral component. In another aspect, the first side prong 204 and the second side prong 206 are removably attachable to the body 202 using fasteners, such as nuts, bolts, screws, rivets, etc. In another aspect, the first side prong 204 and the second side prong 206 are attached to the body 202 using an adhesive. In one aspect, the first side prong 204 and the second side prong 206 extend an identical distance from the body 202. In another aspect, the first side prong 204 and the second side prong 206 extend different distances from the body 202.

The first side prong 204 supports upwardly extending first teeth 205 thereon. The first teeth 205 extend from the first side prong 204 toward the second side prong 206. Similarly, the second side prong 206 supports upwardly extending second teeth 207 thereon extending from the second side prong 206 toward the first side prong 204. In one aspect, as shown in FIG. 2, the first teeth 205 and the second teeth 207 are vertically (longitudinally) staggered relative to one another. In another aspect, the first teeth 205 and the second teeth 207 are not vertically staggered relative to one another such that each first tooth 205 of the first teeth 205 is vertically aligned with a corresponding second tooth 207 of the second teeth 207. The first side prong 204 includes a first number of first teeth 205 and the second prong 206 includes a second number of second teeth 207. In one aspect, the first number of first teeth 205 and the second number of second teeth 207 are identical. In another aspect, the first number of first teeth 205 and the second number of second teeth 207 are different. In one aspect, as shown in FIG. 2, the first side prong 204 comprises three first teeth 205 and the second prong 206 comprises three second teeth 207. In other aspects, the first side prong 204 and the second side prong 206 comprise fewer than three teeth (one or two teeth, for example) or more than three teeth (four, five, or six teeth, for example).

In some aspects, the first side prong 204 and the second side prong 206 define tapered tips 208 that taper from a first point 210 to a second point 212 radially inward relative to the first point 210. In one aspect, the distance between the first points 210 is equal to, or substantially equal to, a diameter of the wellbore 106 such that the first points 210 may engage or ride along the interior surface 114 (FIG. 1) of the wellbore 106 as the wireline fishing tool 118 is conveyed toward the loose wireline 112 by the conveyance 116. In another aspect, the first side prong 204 and second side prong 206 extend laterally outward relative to the body 202 such that a lateral distance between the first points 210 is greater than a diameter of the body 202 and, in some aspects, greater than the diameter of the wellbore 106. In some such aspects, the first side prong 204 and second side prong 206 are flexible toward one another to allow the wireline fishing tool 118 to enter the wellbore 106 and then releasable, causing the first points 210 to ride along the interior surface 114 of the wellbore 106. The first points 210 are arranged to slide between the interior surface 114 of the wellbore 106 and the loose wireline 112, causing the loose wireline 112 to slide along the tapered tips 208, from the first point 210 toward the second point 212, becoming partially compressed (gathered) between the first side prong 204 and the second side prong 206.

The wireline fishing tool 118 further comprises a third or central prong 220 extending from a center of the body 202. The central prong 220 is disposed radially between the first side prong 204 and the second side prong 206. As illustrated in FIG. 2, the central prong 220 extends longitudinally along the axis $A_O$. The third prong 220 may be movable relative to the body 202, the first side prong 204, and the second side prong 206 between an extended state and a retracted state, as will be described in more detail below. In some aspects, in the extended state, the central prong 220 extends a greater longitudinal distance from the body 202 when compared to the first side prong 204 and/or second side prong 206. In one such aspect, in the extended state, the first points 210 of the first side prong 204 and the second side prong 206 are positioned a first longitudinal distance from the body 202, and a tip 222 of the central prong 220 is positioned a second longitudinal distance greater than (beyond) the first points 210 of the first side prong 204 and second side prong 206. In one aspect, in the retracted state, the central prong 220 extends a lesser longitudinal distance from the body 202 when compared to the first side prong 204 and/or second side prong 206. In one such aspect, in the retracted state, the tip 222 of the central prong 220 is positioned a third longitudinal distance from the body 202 and the first points 210 of the first side prong 204 and the second side prong 206 are positioned the first longitudinal distance from the body 202, which is greater than (beyond) the tip 222 of the central prong 220.

The central prong 220 comprises a toothed shaft 221, a first plurality of upwardly extending first teeth 225 extending from the toothed shaft 221 toward the first side prong 204, and a second plurality of upwardly extending second teeth 227 extending from the toothed shaft 221 toward the second side prong 206. In one aspect, as shown in FIG. 2, each first tooth 225 of the plurality of first teeth 225 is vertically aligned with a second tooth 227 of the plurality of second teeth 227. In another aspect, the first teeth 225 and the second teeth 227 are vertically staggered relative to one another. In one aspect, the teeth 225, 227 extending from the toothed shaft 221 are vertically aligned with the teeth 205, 207 extending from the respective first side prong 204 and second side prong 206. In another aspect, the teeth 225, 227 extending from the toothed shaft 221 are vertically stagged from the teeth 205, 207 extending from the respective first side prong 204 and second side prong 206. In another aspect, as is shown in FIG. 2, some of the teeth 225, 227 extending from the toothed shaft 221 are vertically stagged from the teeth 205, 207 extending from the respective first side prong 204 and second side prong 206 and some of the teeth 225, 227 extending from the toothed shaft 221 are vertically aligned with a the teeth 205, 207 extending from the respective first side prong 204 and second side prong 206.

The central prong 220 includes a first number of first teeth 225 and a second number of second teeth 227. In one aspect, the first number of first teeth 225 and the second number of second teeth 227 are identical. In another aspect, the first number of first teeth 225 and the second number of second teeth 227 are different. In one aspect, as shown in FIG. 2, the central prong 220 comprises four first teeth 225 and four second teeth 227. In other aspects, the central prong 220 comprises fewer than four first and/or second teeth 225, 227 (one, two, or three teeth, for example) or more than four first and/or second teeth 225, 227 (five, six, or seven teeth, for example). In some aspects, the number of teeth extending from the first side prong 204 and second side prong 206 is different than the number of teeth extending from the central prong 220 toward the respective first side prong 204 and second side prong 206. In one such aspect, as shown in FIG. 2, the first side prong 204 and second side prong 206 each support three teeth 205, 207 and the central prong 220 comprises four teeth (i.e., more than three teeth) extending toward each of the first side prong 204 and the second side prong 206. In another such aspect, the number of teeth 205, 207 extending from the first side prong 204 and second side prong 206 is greater than the number of teeth 225, 227 extending from the toothed shaft 221 toward the respective first side prong 204 and second side prong 206. In one aspect, the number of teeth 205, 207 extending from the first side prong 204 and second side prong 206 are identical to the number of teeth 225, 227 extending from the central prong 220 toward the respective first side prong 204 and second side prong 206.

The first teeth 225 and the second teeth 227 are movable relative to the toothed shaft 221 between a deployed state (as illustrated in FIG. 2), in which the first teeth 225 and the second teeth 227 extend outwardly (laterally) from the toothed shaft 221, and a stowed state, in which the first teeth 225 and the second teeth 227 are retracted into and stowed within the toothed shaft 221. In some aspects, the toothed shaft 221 comprises a hollow shaft sized to receive and stow the teeth 225, 227 in their respective stowed states. Other embodiments are envisioned where the first teeth 225 and second teeth 227 are not movable relative to the toothed shaft 221 and, rather, are fixed to the toothed shaft in the deployed state.

Figure 2A:
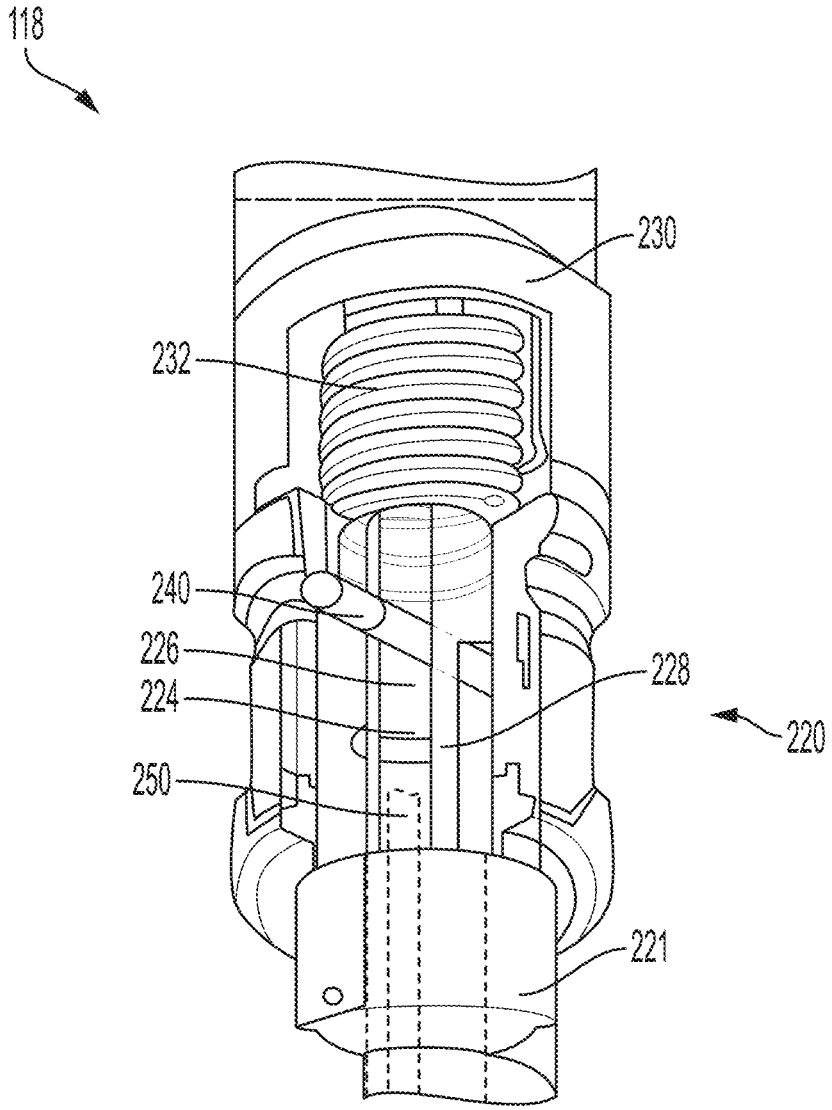
FIG. 2A is a detailed view of an upper portion of the wireline fishing tool of FIG. 2, according to at least one aspect of the present disclosure.

Referring now to FIG. 2A, in some aspects, an actuation mechanism for selectively retracting the toothed shaft 221 may be provided within an upper portion of the wireline fishing tool 118. In some aspects, the body 202 of the wireline fishing tool 118 comprises a hollow shaft 230 and the central prong 220 further comprises a drive shaft 228 extending upwardly from the toothed shaft 221 into the hollow shaft 230. The drive shaft 228 is selectively retractable into the hollow shaft 230 to move the toothed shaft 221 from the extended state to retracted state. The wireline fishing tool 118 further comprises a spring 232 wound around the drive shaft 228. The spring 228 is operably coupled to the drive shaft 228 and the hollow shaft 230 such that the spring 228 functions to drive the central prong 220 from the extended state (an initial or run-in state) toward the retracted state (an activated state). In some aspects, the spring 232 comprises a preloaded extension spring that is transitionable from an extended state (a loaded state) to a resting state (an unloaded state). The extended state of the spring 232 corresponds to the extended state of the central prong 220 and the stowed state of the first teeth 225 and second teeth 227. The resting state of the spring 232 corresponds to the retracted state of the central prong 220 and the deployed state of the first teeth 225 and second teeth 227. In the extended state, the spring 232 is stretched beyond its resting state with potential energy stored therein (preloaded). In the resting state, the preloaded potential energy has been released from the spring 232 and the drive shaft 228 has been driven upwardly with respect the hollow shaft 230. In another aspect, the spring 232 comprises a compression spring.

As shown in FIG. 2A, the central prong 220 may further comprise a rod 250 that extends into the toothed rod 221. The rod 250 may be fixedly attached to the body 202 such that the rod 250 remains stationary with respect to the body 202 as the central prong 220 transitions between the extended and retracted states.

Figure 3:
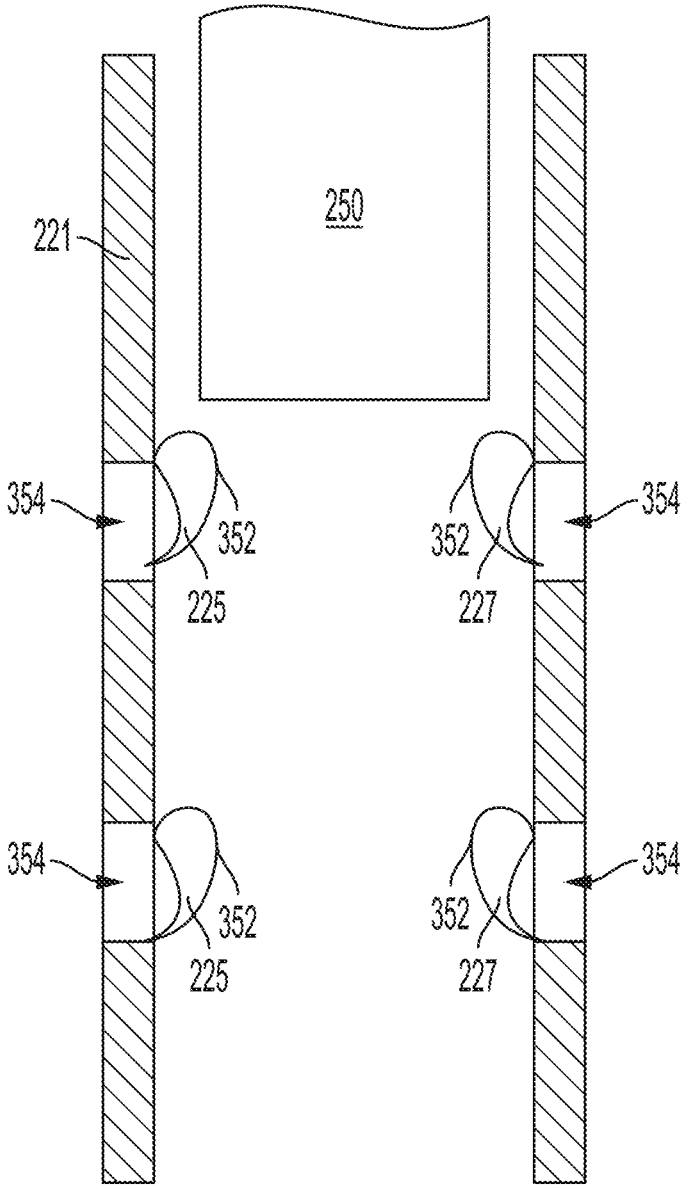
FIG. 3 is a partial schematic view of the third prong of the wireline fishing tool of FIG. 1 in an extended state with teeth of the central prong in respective stowed states, according to at least one aspect of the present disclosure.
Figure 4:
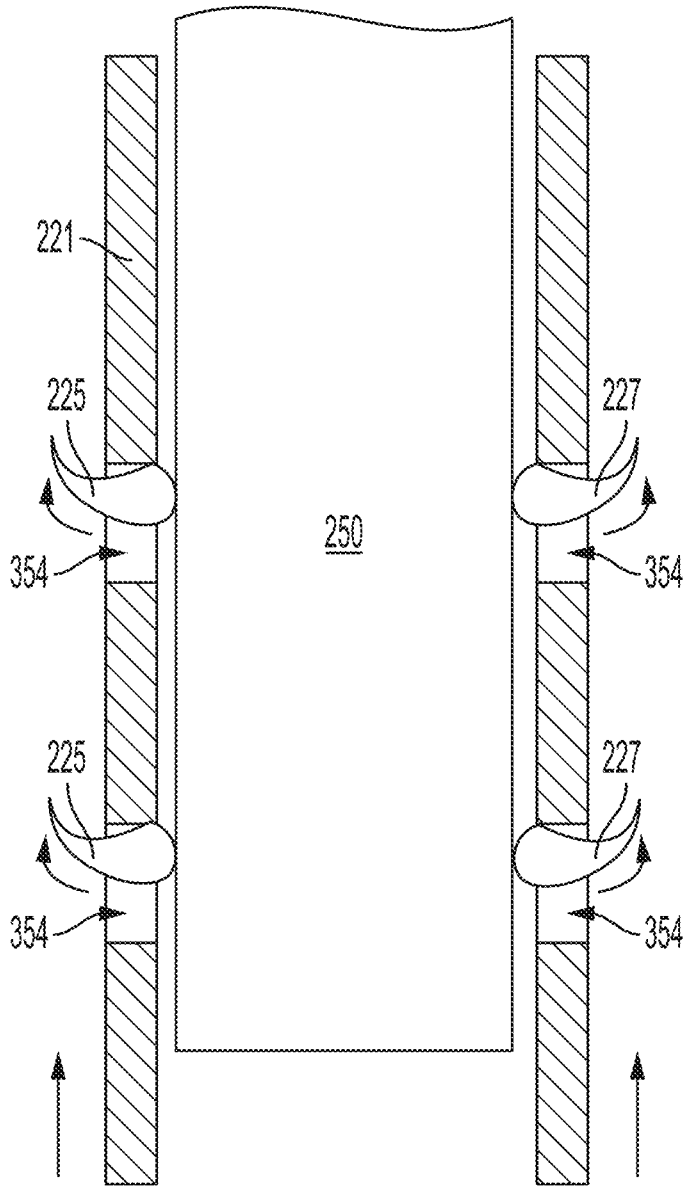
FIG. 4 is a schematic view of the third prong of FIG. 3 moving toward a retracted state with the teeth thereof moving to respective deployed states, according to at least one aspect of the present disclosure.

Referring now to FIG. 3, the central prong 220 is illustrated in its extended state (run-in state) with the first and second teeth 225, 227 in respective stowed states. The first teeth 225 and the second teeth 227 are pivotably coupled to the toothed shaft 221 and are pivotable through slits 354 defined in the toothed shaft 221 to transition between their respective stowed states (FIG. 3) and deployed states (FIG. 4). In some aspects, the central prong 220 further comprises springs (not shown) coupled to the toothed shaft 221 and a corresponding first tooth 225 or second tooth 227 to bias the corresponding first tooth 225 or second tooth 227 into their respective stowed state. The first teeth 225 and second teeth 227 comprise cam surfaces 352 that are sized and configured to be engaged by the rod 250 as the toothed shaft 221, and therefore, the first teeth 225 and second teeth 227, move upwardly toward the retracted state of the central prong 220. As the first teeth 225 and the second teeth 227 move upwardly, the rod 250 progressively engages the cam surfaces 352 of the first teeth 225 and second teeth 227 to rotate the first teeth 225 and second teeth 227 from their respective stowed position (FIG. 3) to their respective deployed position (FIG. 4).

Referring again to FIG. 2A, the wireline fishing tool 118 further comprises a stopper 240 to maintain the spring 232 in the extended state, and thus, the third prong 220 in the extended state and the first teeth 225 and second teeth 227 in their respective stowed states. The drive shaft 228 defines a slot 224 and includes a ledge 226 extending within the slot 224. The stopper 240 extends from the hollow shaft 230 laterally through the slot 224 and abuts the ledge 226 to maintain the spring 232 in the extended state. In some aspects, the stopper 240 comprises a sheer pin. In one aspect, an upward axial force may be applied to the stopper 240 by engaging the toothed shaft 221 with the wireline tool 110 (FIG. 1) and placing weight down on the body 202 with the conveyance 116 (FIG. 1). If the wireline tool 110 is substantially stationary, the weight may cause a reactionary force to be transmitted upwardly through the toothed shaft 221 and the drive shaft 228. The ledge 226 of the drive shaft 228 may then sheer stopper 240. In another aspect, the wireline fishing tool 118 further comprises an actuator 120 (FIG. 1) operably coupled to the central prong 220 and that functions to apply an upward axial force to the toothed shaft 221, drive shaft 228 and/or the stopper 240 that itself is sufficient to transition the stopper 240 from a holding state, in which the stopper 240 maintains the spring 232 in the extended state, to a released state, in which the stopper 240 is broken (sheered) or otherwise displaced, and therefore allows the spring 232 to drive the central prong 220 from the extended state toward the retracted state and the first teeth 225 and second teeth 227 from their stowed states toward the their deployed states. In some aspects, the actuator 120 comprises a wireline jar, a shaft, a cable or a chain that extends through the conveyance 116 to the surface location 104 and is actuatable by an operator. In one aspect, a motor drives (tensions) the actuator 120 to supply the required force to break (sheer) the stopper 240, thereby transitioning the sheer pin 240 to the released state. In some aspects, the well system 100 includes a timer that measures elapsed time and the actuator 120 is configured to be actuated based on a predefined amount of time elapsing.

In other aspects, the stopper 240 is laterally moveable through the slot 224. In some such aspects, the stopper 240 is laterally moveable between the holding state, in which the stopper 240 extends through the slot 224 and abuts the ledge 226, and the released state, in which the stopper 240 is laterally moved out of the slot 224 and therefore allows the spring 232 to drive the third prong 220 from the extended state toward the retracted state and the first teeth 225 and second teeth 227 from their stowed states toward the their deployed states. In one aspect, the wireline fishing tool 118 comprises a control circuit comprising a coil that is energizable to generate a magnetic field and pull the stopper 240 from the holding state to the released state. In another aspect, the wireline fishing tool 118 comprises a pneumatic actuator to drive the stopper 240 from the holding state to the released state.

In use, the wireline fishing tool 118 is introduced into the wellbore 106 (FIG. 1) and moved toward the loose wireline 112 and wireline tool 110 with the conveyance 116. Notably, as the wireline fishing tool 118 is moved toward the loose wireline 112 and the wireline tool 110, the central prong 220 is in the extended position and the first teeth 225 and second teeth 227 are in their respective stowed positions.

As discussed above, as the wireline fishing tool 118 is moved toward the loose wireline 112 by the conveyance 116, the first points 210 of the first side prong 204 and second side prong 206 ride along the interior surface 114 of the wellbore 106 and slide between the interior surface 114 and the loose wireline 112, causing the wireline 112 to slide along the tapered tips 208 of the first side prong 204 and second side prong 206, from the first point 210 toward the second point 212, and partially compress between the first prong 204 and the second prong 206. At substantially the same time, the central prong 220 moves through the center of the coiled wireline 112 toward the wireline tool 110.

When desired, a user can then actuate the central prong 220. Specifically, as discussed above, a user can actuate an actuator 120 to transition the stopper 240 from the holding state to the released state, allowing the central prong 220 to move from the extended position toward the retracted position. As the third prong 220 moves through the now partially grasped wireline 112 toward the retracted position, the first teeth 225 and second teeth 227 progressively transition from their respective stowed states to deployed states to progressively "catch" portions of the wireline 112 and pull the wireline 112 further upward toward the body 202 between the first side prong 204 and second side prong 204. As the wireline 112 is pulled upward between the first side prong 204 and the second side prong 206, the wireline 112 is further "caught" by the first teeth 205 extending from the first side prong 204 and the second teeth 207 extending from the second side prong 206, further increasing the grasp that the wireline fishing tool 118 has on the wireline 112, and thus, further increasing the chances of success of pulling the wireline 112 and the wireline tool 110 out of the wellbore 106. With the central prong 220 in the retracted position, the conveyance 106 can then apply an upward axial force to the wireline fishing tool 118 to pull the wireline tool 110 upwardly through the wellbore 106 toward the surface location 104.

Figure 5:
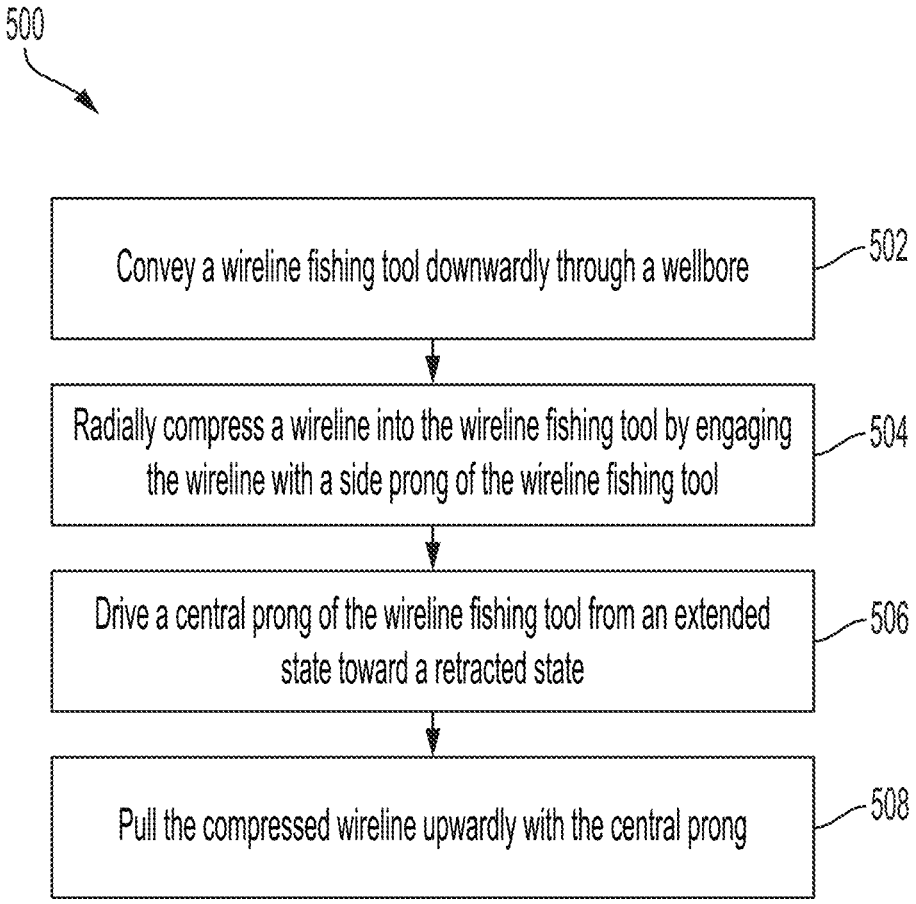
FIG. 5 is a flowchart illustrating a method for extracting a wireline using the wireline fishing tool of FIG. 1, according to at least one aspect of the present disclosure.

Referring now to FIG. 5, a method 500 for extracting a wireline using the wireline fishing tool is provided, according to at least one aspect of the present disclosure. The method 500 comprises conveying 502 a wireline fishing tool downwardly through a wellbore. In one aspect, a wireline fishing tool, such as wireline fishing tool 118, is conveyed downwardly through a wellbore, such as wellbore 106, such as with a conveyance 116. In some aspects, the wireline fishing tool is conveyed through the wellbore with gravity.

The method 500 further comprises gathering, e.g., radially compressing 504, a wireline into the wireline fishing tool with a first side prong thereof based on the wireline fishing tool being driven or otherwise conveyed downwardly through the wellbore. In one aspect, as the wireline fishing tool 118 is moved toward a wireline, such as loose wireline 112, by the conveyance 116, a point of a side prong of the wireline fishing tool, such as first point 210 of a first side prong 204 of the wireline fishing tool 118, slides between an interior surface 114 surface of the wellbore 106 and the loose wireline 112, causing the wireline 112 to slide along a tapered tip 208 of the first side prong 204, from the first point 210 toward a second point 212, to radially compress the loosed wire 112 in the wireline fishing tool.

The method 500 further comprises driving 506 a central prong relative to the first side prong from an extended state toward a retracted state. In some aspects, a user can actuate the central prong 220, to move the central prong 220 from an extended state to a retracted state. In one such aspect, the user can transition a stopper, such as stopper 240, from a holding state to the released state, allowing the central prong to move from the extended position toward the retracted position.

The method 500 further comprises pulling 508 the compressed wireline upwardly with the central prong based on the central prong moving toward the retracted state. In some aspects, as the central prong moves through the partially compressed wireline toward the retracted position, teeth of the second prong, such as first teeth 225 and second teeth 227, can progressively transition from their respective stowed states to deployed states to progressively "catch" portions of the wireline and pull the wireline further. In some such aspects, as the wireline is pulled upward, the wireline is further "caught" by teeth of the first prong, such as first teeth 205 extending from the first prong 204, further increasing the grasp that the wireline fishing tool has on the wireline.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A wireline fishing tool, comprising:

a body;

at least one side prong extending from a lateral side of the body; and a central prong extending from a center of the body and movable relative to the body between an extended state and a retracted state, the central prong including:

a toothed shaft retractable with respect to the body to move the central prong from the extended state to the retracted state; and a tooth movable relative to the toothed shaft between a stowed state, in which the tooth is disposed within the toothed shaft, and a deployed state, in which the tooth extends from the toothed shaft, wherein the tooth is movable from the stowed state toward the deployed state based on the central prong moving from the extended state to the retracted state.

2. The wireline fishing tool of claim 1, wherein the side prong extends a first length from the body, and wherein, in the extended state, the central prong extends a second length from the body greater than the first length.

3. The wireline fishing tool of claim 2, wherein the at least one side prong includes a tapered tip at a lower end thereof.

4. The wireline fishing tool of claim 1, further comprising a spring operably coupled to the body and the central prong to selectively drive the central prong from the extended state to the retracted state.

5. The wireline fishing tool of claim 4, further comprising a stopper operably engaged with the central prong to maintain the central prong in the extended state.

6. The wirelines fishing tool of claim 5, wherein the stopper comprises a sheer pin.

7. The wireline fishing tool of claim 1, wherein the at least one side prong supports a tooth thereon that extends radially toward the central prong.

8. The wireline fishing tool of claim 1, wherein the at least one side prong is radially flexible with respect to the body.

9. A method, comprising:

conveying a wireline fishing tool into a wellbore and encountering a wireline fallen within the wellbore;

radially compressing the wireline into the wireline fishing tool by engaging the wireline with at least one side prong of the wireline fishing tool based on the wireline fishing tool being conveyed downwardly through the wellbore;

driving a central prong of the wireline fishing tool from an extended state toward a retracted state; and pulling the compressed wireline upwardly with the central prong based on the central prong moving toward the retracted state.

10. The method of claim 9, further comprising driving a tooth supported on the central prong from a stowed position to a deployed position based on the central prong moving toward the retracted state, and wherein pulling the compressed wireline upwardly with the central prong comprises pulling the compressed wireline upwardly with the tooth supported on the central prong.

11. The method of claim 10, further comprising engaging the wireline with a tooth of the at least one side prong based on the wireline being pulled upwardly with the tooth supported by the central prong.

12. The method of claim 11, further comprising pulling the wireline upwardly through the wellbore with the tooth of the at least one side prong.

13. The method of claim 9, wherein driving the central prong toward the retracted state comprises driving the central prong toward the retracted state with a spring.

14. The method of claim 13, further comprising transitioning a stopper to a released state, wherein driving the central prong toward the retracted state comprises driving the central prong toward the retracted state with the spring based on the stopper being transitioned to the released state.

15. The method of claim 9, wherein compressing the wireline into the wireline fishing tool comprises sliding the wireline along a tapered surface of the at least one side prong based on the wireline fishing tool being conveyed downwardly through the wellbore.

* * * * *